United States Patent [19]

Teruyama

[11] 4,334,840

[45] Jun. 15, 1982

[54] GEAR PUMP OR MOTOR WITH SERRATED GROOVES ON INNER WALL FOR BREAK-IN OPERATION

[75] Inventor: Hideo Teruyama, Shobu, Japan

[73] Assignee: Kayaba Kogyo Kabushiki Kaisha, Tokyo, Japan

[21] Appl. No.: 114,884

[22] Filed: Jan. 24, 1980

[30] Foreign Application Priority Data

Jan. 26, 1979 [JP] Japan ..... 54/7251

[51] Int. Cl.[3] ..... F01C 1/18; F01C 21/10; F03C 2/08; F04C 2/18

[52] U.S. Cl. ..... 418/1; 418/179; 418/206; 29/156.4 R

[58] Field of Search ..... 418/178, 179, 205, 206, 418/1; 29/156.4 R, 156.4 WL

[56] References Cited

U.S. PATENT DOCUMENTS

| | | | |
|---|---|---|---|
| 2,491,677 | 12/1949 | McCulloch | 418/179 |
| 2,519,557 | 8/1950 | Flanagan | 418/206 |
| 3,704,968 | 12/1972 | Haupt | 418/179 |

*Primary Examiner*—John J. Vrablik

*Attorney, Agent, or Firm*—Saul Jecies

[57] ABSTRACT

In order to prevent a decrease in volumetric efficiency from occurring when a gear pump or motor, 10, is operated at room temperature after operating at a lower temperature or when it is operated at a higher temperature after operation at a lower temperature, the housing, 13, containing two interlocking gears 17 and 18 is made of a ferrous material, which is the same as that of the two gears, and a large number of serrated grooves, 40, are disposed in the axial direction on the low pressure side of the inner wall surfaces of the gear bower 16. Therefore in the break-in operation of the gear pump or motor when the inner wall surfaces at the low pressure side of the gear bower are cut off by the tooth crests of the two gears, built-up edges, which are then formed on the tooth crests of these gears, can drop off immediately, owing to the occurrence of impact forces when they clash with the angular parts of the grooves, and result in a smooth break-in to inner wall surfaces at the low pressure side of the gear bower. Thus the use of housings made of ferrous materials is excellent for the above temperature characteristics.

7 Claims, 7 Drawing Figures

GEAR PUMP OR MOTOR WITH SERRATED GROOVES ON INNER WALL FOR BREAK-IN OPERATION

BACKGROUND TO THE INVENTION

The present invention relates to an improvement in the temperature characteristics of gear pumps or motors.

Generally in the operation of a gear pump or motor, if there are more clearances than are needed between the tooth crests of the two interlocking gears and the inner wall surfaces of the gear bower, the liquid on the high pressure side will leak in a large amount through these clearances to the low pressure side. This will not only lower the volumetric efficiency of the gear pump or motor significantly but also generate heat which could result in seizure.

It is common practice, therefore, that in order to keep the tooth crests of the two gears in contact with, at least, some part of the inner wall surfaces of the gear bower during operation, the addendum circle diameter of the gears, inner diameter of the gear bower, the bearings supporting the respective gear shafts and other assembly parts are optimized beforehand and, after assembly of the gear pump or motor, the break-in operation is performed. In the break-in operation, the two gears are pressed by the liquid on the high pressure side to the low pressure side so that the inner wall surfaces are cut off at the low pressure side by the tooth crests of the two rotating gears. In this way, by applying a break-in to a stipulated position of the gear bower, a minimized radial clearance is secured in the operation of the gear pump or motor and thus, even if there are some manufacturing errors with regard to dimensions of the respective assembly parts, the tooth crests of the two gears are kept in contact with the inner wall surfaces at the low pressure side of the gear bower. This seals the liquid which tends to leak from the high pressure side to the low pressure side.

Under these circumstances, it has been established as common sense, among those who are skilled in the art, that the housing may not be made of a material of the same type as used for the two gears which are made of a ferrous material. The reason is that it was believed impossible to apply a break-in having good smooth surfaces on the grounds that built-up edges are formed on the tooth crests of each gear, made of a ferrous material, since they cut into the inner wall surfaces of the gear bower, which is made of a material of the same ferrous type, during the break-in operation. This results in burrs and scratches on the cut surfaces of the gear bower.

Conventionally, therefore, the housing has been made of aluminum alloy materials which produce no built-up edges on the tooth crests of the two gears when they cut the inner wall surfaces of the gear bower. By using such a housing made of aluminum alloy materials, it is certainly possible to give a good break-in to the inner wall surfaces of the gear bower and consequently to fabricate gear pumps or motors having apparently a good volumetric efficiency and no chance of seizure.

Nevertheless, it has been appreciated that even such gear pumps or motors have still the following defect depending on their working conditions. Namely, if the gear pump or motor is used at a lower temperature after the break-in operation at room temperature, such a temperature change will cause a larger shrinkage in the housing made of an aluminum alloy material than in the gears made of a ferrous material, due to the difference in heat expansion coefficient between these materials. Consequently tooth crests of each gear will cut deeper inner wall surfaces of the gear bower. Therefore, when the gear pump or motor operates again at room temperature or a high temperature, the radial clearance becomes larger than needed due to the difference in heat expansion coefficient between the gears and housing, so that the internal liquid leakage flowing from the high pressure side to the low pressure side may increase, thus not only lowering the volumetric efficiency significantly but also causing a seizure hazard in some cases.

On the other hand, in order to resolve this defect, inherent in aluminum alloy materials, it is essential to make the housing out of a ferrous material, the same as the two gears. However, since built-up edges are formed on tooth crests of each gear when the break-in is applied, it has been impossible up to now to have smoothly cut surfaces, which left the technical problem that no housings made of ferrous materials were usable.

SUMMARY OF THE INVENTION

The purpose of the present invention, therefore, is to offer a gear pump or motor of excellent temperature characteristics by making it possible, while using a housing made of ferrous materials, to have a good break-in operation by permitting the tooth crests of the two gears to cut smoothly the inner wall surfaces at the low pressure side of the gear bower in the housing.

In this invention, bearing this in mind, the housing containing the two interlocking gears is made of a ferrous material the same as that used in the gears, and a large number of serrated grooves are disposed in the axial direction on the inner wall surfaces at the low pressure side of the gear bower.

Thus, even if during the break-in operation of the gear pump or motor, manufactured in this way, built-up edges form on the tooth crests of each gear when they cut the inner wall surfaces on the low pressure side of the gear bower, they will clash successively, without growing larger, with each angular part of the grooves and drop off immediately owing to the occurrence of impact forces. Therefore, the tooth crests of each gear cut, during break-in, without carrying any built-up edges at all, so that the inner wall surfaces at the low pressure side of the gear bower may be provided with the smooth break-in operation seen in housings made of conventional aluminum alloys. This permits the use of housings made of ferrous materials in the manufacture of gear pumps or motors with excellent temperature characteristics.

In the following, an example of the present invention will be detailed referring to the drawings attached. Although the description of the invention is made with regard to a gear pump, its principles are, of course, applicable to gear motors.

DESCRIPTION OF THE PREFERRED EMBODIMENTS

Figure 1:
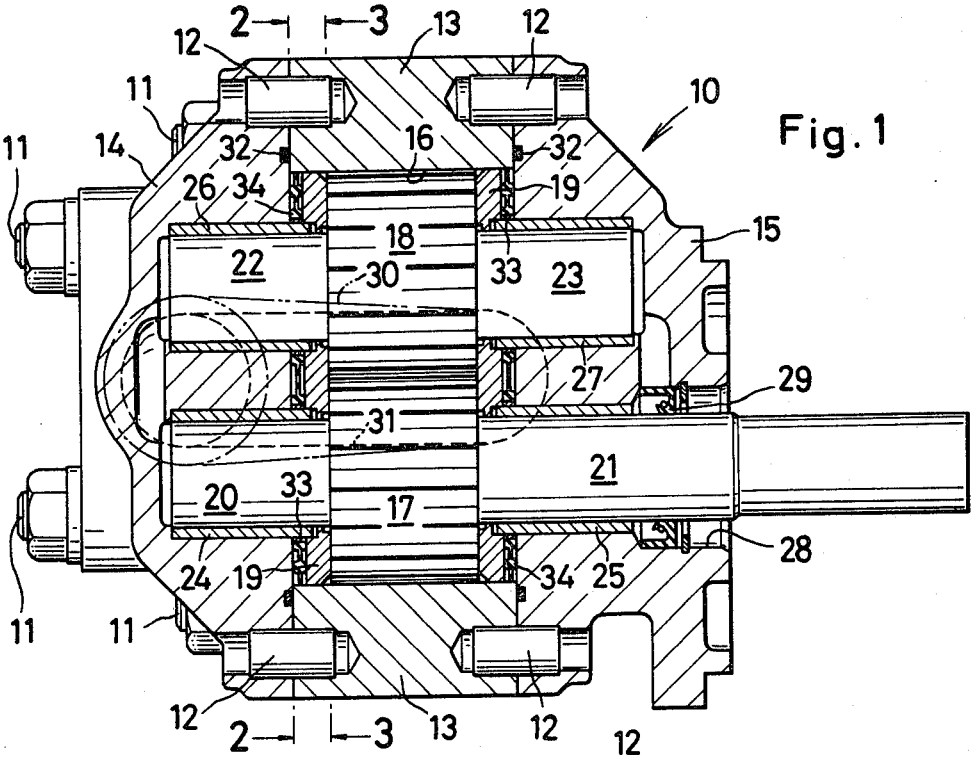
FIG. 1 is a front elevation showing a cross-section of the invention applied to a gear pump.

In FIG. 1, a gear pump 10 which is assembled by means of the series of bolts, 11, has a housing, 13, and end covers, 14 and 15, which are kept in order by means of dowel pins, 12.

There is a gear bower, 16, of a figure-8 type, inside the housing, which makes-up the pumping chamber. Inside the gear bower are the pumping elements—two interlocking gears, 17 and 18, and two pressure plates, 19, which can move in the axial direction and seal both surfaces of the gears. The tooth crests of the gears and the upper and lower circumferential surfaces of the pressure plates are kept strictly in contact with the inner wall surfaces of the gear bower.

The gears, 17 and 18, have shafts 20, 21 and 22, 23 respectively, and these shafts pass through the pressure plates. The shafts are supported by and rotate freely in bushings 24, 25 and 26, 27 which are fitted as bearing members into the end covers, 14 and 15. One shaft, 21, of gear, 17, protrudes outwards through a hole, 28, of end cover, 15, and may be connected to a power source outside the gear pump, 10. The hole, 28, has an oil seal, 29, so as to seal up clearances between the shaft and the hole.

In order to receive the liquid from the outside, the pump has a liquid entrance passage, 30, as shown by the dotted line in FIG. 1, and a liquid exit passage, 31, as shown by the broken line in the same figure. The passages run from end cover, 14, to the housing, 13, and to the middle of the other end cover, 15. These passages, 30 and 31, as seen in FIGS. 2 and 3 are connected to both sides of the gear bower and make outer ports for suction and delivery of the liquid.

Particularly in the case of this gear pump the housing containing the gear bower as the pumping chamber is made of a ferrous material, e.g. gray iron casting, the same as the gears. On the contact surfaces between the housing and end covers there are O-rings, 32, which enclose the gear bower and the liquid entrance and exit passages so that the gear bower is tightly sealed.

Figure 2:
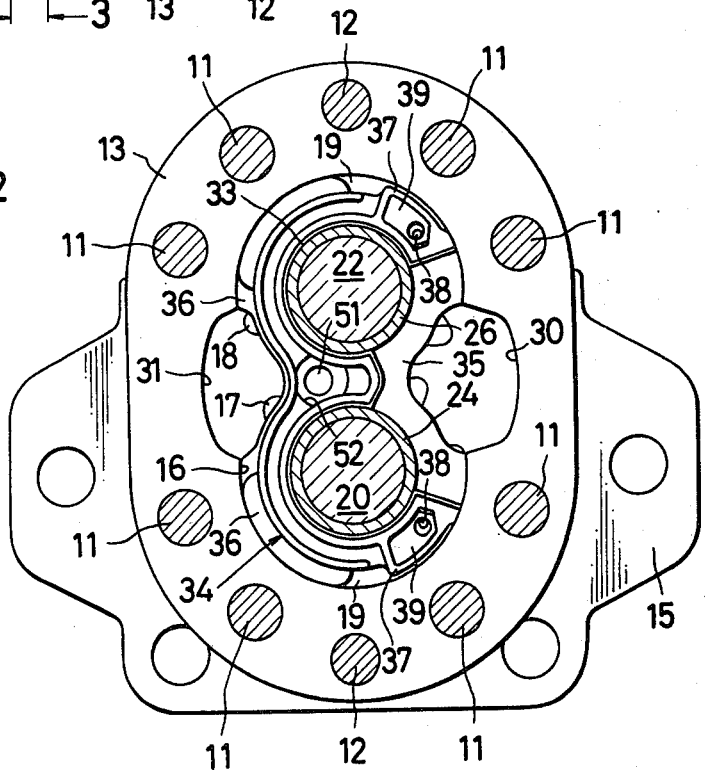
FIG. 2 is an end elevation along Line 2—2 in FIG. 1.
Figure 3:
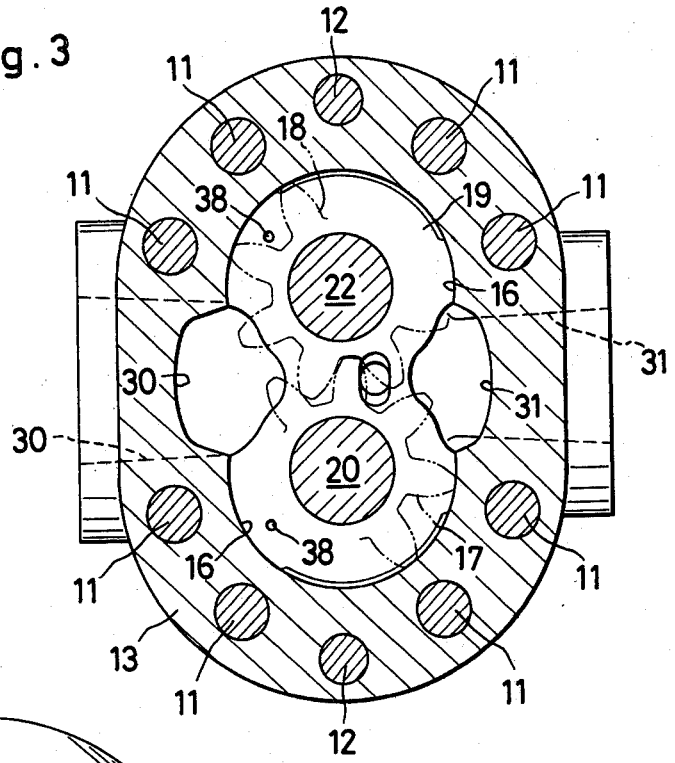
FIG. 3 is an end elevation along Line 3—3 in FIG. 1.

As shown in FIGS. 1 and 2, between the pressure plates and the end covers are inserted figure-3 type seals, 34, with a backup part, 33, fitted inside. Since these figure-3 type seals do not relate directly to the present invention, and since they are specified already in U.S. patent application Ser. No. 76,783 filed Sept. 18, 1979 now U.S. Pat. No. 4,281,974, Aug. 4, 1981 which we have used before, their detailed description is omitted here.

In short, these seals work jointly with the O-rings, 32, to partition the back surfaces of the pressure plates into a low pressure zone, 35, leading to the liquid entrance passage 30, a high pressure zone, 36, leading to the liquid exit passage, 31, and an intermediate zone, 39, which is enclosed by the loopy parts, 37, which are inserted at both ends of the seals, 34, and which leads to the space part of the gears through a hole, 38, in the pressure plates. In the operation of the gear pump the liquid is introduced to these three pressure zones and forces the pressure plates to both side surfaces of the gears. Thus both side surfaces of the gears are sealed tightly by the pressure plates.

When the shaft, 21, is driven by an outside power source, thereby starting the gear pump, gear 17 drives the gear 18 and the liquid in the entrance passage is caught in the space of the gears and, while flowing along the inner wall surfaces of the gear bower, it becomes the high pressure liquid in the exit passage before it is discharged. As a result, the gears are forced by the high pressure liquid in the exit passage toward the entrance passage side. At the exit passage side, the tooth crests of the gears move from the inner wall surfaces of the gear bower, while at the entrance passage side the tooth crests of the gears are pressed onto the inner wall surfaces of the gear bower.

Thus, at the initial stage of the break-in operation of the gear pump, tooth crests of the gear cut the inner wall surfaces at the low pressure side of the gear bower to apply a break-in action to that part. If this break-in is performed smoothly, the clearance between the tooth crests of the gears and the inner wall surfaces of the gear bower is always kept to a minimum during operation of the gear pump, so that the high pressure liquid in the liquid exit passage is best prevented from leaking to the entrance passage side through the clearance. Thus a good volumetric efficiency can be achieved and the possibility of seizure and other hazards prevented. However, in the case where the housing is made of a ferrous material which is the same as the material used for the gear, so as to secure good temperature characteristics, built-up edges will not only be produced on tooth crests of the gears as they cut the inner wall surfaces at the low pressure side of the gear bower but they will also grow progressively larger. This makes it impossible to apply a smooth break-in to the inner wall surfaces at the low pressure side of the gear bower. Thus, this part is unable to prevent leakage between the exit passage and the entrance passage, and consequently the increasing leakage from this part not only lowers the volumetric efficiency as a gear pump but also increases the chances of seizure. Thus the gear pump may be useless.

Figure 4:
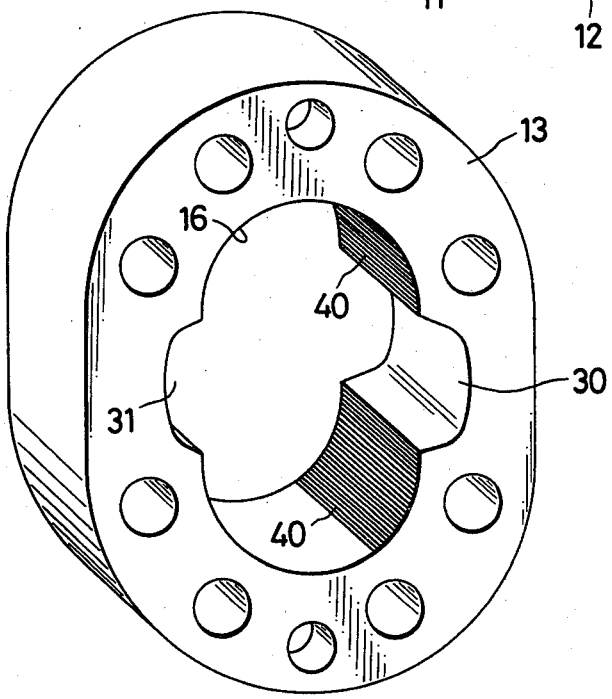
FIG. 4 is an isometric showing the housing before the break-in is applied.
Figure 5:
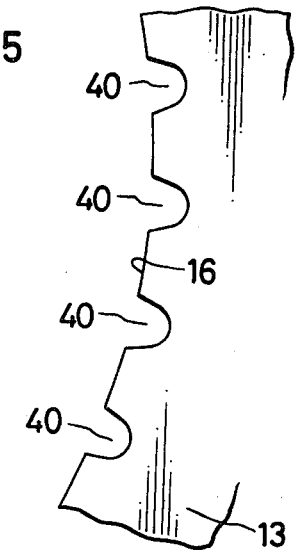
FIG. 5 is an enlarged partial side elevation of the housing showing the grooves which are disposed on the inner wall surfaces of the gear bower.
Figure 6:
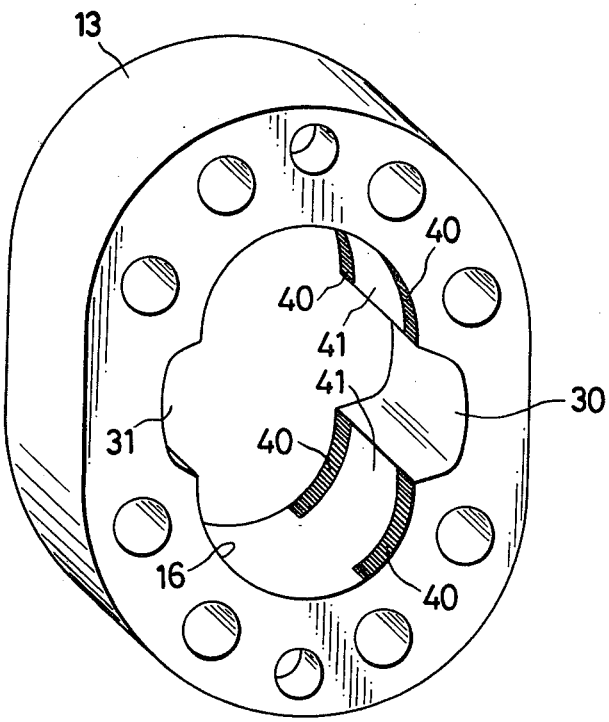
FIG. 6 is an isometric showing the housing after the break-in is applied.

In the present invention, therefore, as shown in FIGS. 4 to 6, particularly FIG. 4, a large number of serrated grooves, 40, are cast in the axial direction.

Thus, even though built-up edges may be produced on the tooth crests of the gears as the tooth crests cut the inner wall surfaces at the low pressure side of the gear bower, these built-up edges clash with the angular part of the grooves disposed on the inner wall surfaces at the low pressure side and drop off immediately, owing to impact forces, from the tooth crests without growing larger. As a result, every tooth crest may cut during the break-in without carrying any built-up edges. Thus, by casting the grooves somewhat shallower than the break-in depth, it is possible to apply a smooth and favorably shaped break-in to a stipulated area on the inner wall surfaces at the low pressure side, as seen in FIG. 6.

Thus in a housing made of a ferrous material one can see the smooth break-in operation seen in housings made of conventional aluminum alloy materials, making it possible to offer gear pumps with a good volumetric efficiency, excellent temperature characteristics and no possibility of seizure and other hazards.

Figure 7:
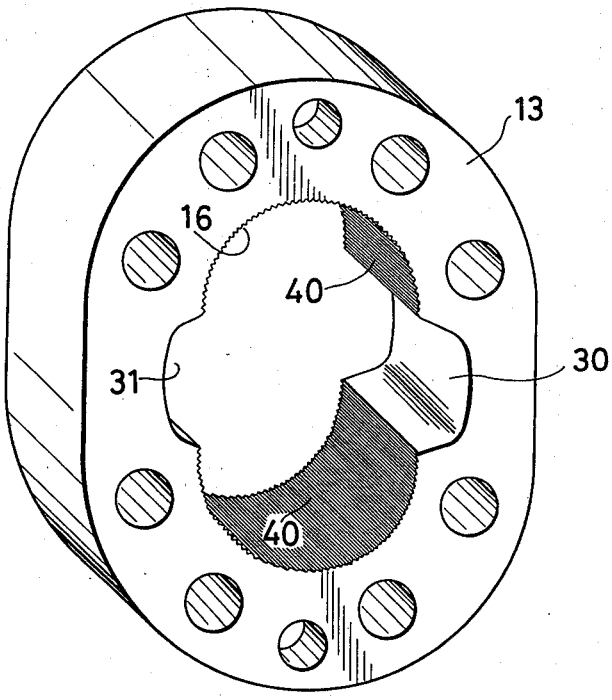
FIG. 7 is an isometric showing of the housing before the break-in is applied and wherein the grooves are disposed over the entire inner wall surface.

In addition, the serrated grooves may be disposed over the whole surface area of the gear bower, illustrated in FIG. 7 of the drawings. These grooves are not necessarily limited in shape to the semicircle shown in FIG. 5, and a V or square shape is also acceptable.

Although a preferable arrangement of the present invention is set forth in the above description, it it clear that the present invention is applicable, to gear pumps of other types as well as of the same construction as mentioned above.

What is claimed is:

1. A method of providing in a gear pump or motor a minimal clearance between a relatively smooth inner wall surface on the low pressure side of a bower and the crest of the gear teeth comprising the steps of rotating the inter-meshing gears made of ferrous material having a pre-determined co-efficient of expansion at the maximum operational speed in a bower made of ferrous material having a co-efficient of expansion substantially identical with the co-efficient of expansion of said gear teeth;

said bower having at least on the low pressure side of its inner wall surface serrations cut transverse to the rotation of said gear teeth;

allowing the crest of the gear teeth to impact on said serrations to wear down said serrations;

creating built-up edges on the crest of said gear teeth; and breaking off said built-up edges by impacting said crests on the angular part of said serrations.

2. A gear pump or motor, comprising a housing made of a ferrous material;

a bower made of ferrous material having a pre-determined coefficient of expansion located in said housing and having a pre-determined width, a low pressure side, a high pressure side and an inner wall surface;

two intermeshing gears having teeth with crests located in said bower and mounted on substantially parallel shafts;

said gears made of ferrous material having a coefficient of expansion substantially identical with the coefficient of expansion of said bower;

serrated grooves having angular parts cut parallel to said parallel shafts to a predetermined depth on said inner wall surface of said bower at least on said low pressure side of said bower;

whereby during the break-in operation built up edges are formed on said crests of said teeth due to the impact of said gears onto said inner wall surface of said bower, said built-up edges clashing with the angular part of the grooves disposed on the inner wall surface at said low pressure side and dropping off immediately upon impact to form swarf, thus preventing said built-up edges on said crest of said gear teeths to grow larger, and forming a minimal clearance between the crests of the teeth and a smooth surface on said inner wall of said bower on said low pressure side.

3. A gear pump or motor as claimed in claim 2 wherein the ferrous material of said housing has a coefficient of expansion substantially identical to the coefficient of expansion of said bower.

4. A gear pump or motor as claimed in claim 2 wherein said serrated grooves have a arcuate cross section.

5. A gear pump or motor as claimed in claim 2 wherein said serrated grooves have a "V" shaped cross-section.

6. A gear pump or motor as claimed in claim 2 wherein said serrated grooves are cut over the whole inner wall surface of said bower.

7. A gear pump or motor as claimed in claim 2 wherein said pre-determined depth is shallower than any break-in depths required to form a smooth inner wall surface of said bower.

* * * * *